US007896350B2

(12) United States Patent
Harries

(10) Patent No.: US 7,896,350 B2
(45) Date of Patent: Mar. 1, 2011

(54) COLLAPSIBLE BALL GAME BASKET AND APPARATUS FOR PLAYING A BALL GAME

(76) Inventor: Jonathan Harries, Kingston upon Thames, Surrey (GB)

( * ) Notice: Subject to any disclaimer, the term of this patent is extended or adjusted under 35 U.S.C. 154(b) by 6 days.

(21) Appl. No.: 12/317,252

(22) Filed: Dec. 19, 2008

(65) Prior Publication Data

US 2009/0176604 A1 Jul. 9, 2009

(30) Foreign Application Priority Data

Dec. 20, 2007 (GB) ..... 0724899.0

(51) Int. Cl.
*A63B 63/00* (2006.01)
*A63B 63/08* (2006.01)

(52) U.S. Cl. ..... 273/402; 473/479

(58) Field of Classification Search ..... 273/398–402; 473/476, 478–489; 248/431, 432
See application file for complete search history.

(56) References Cited

U.S. PATENT DOCUMENTS

| | | | | | |
|---|---|---|---|---|---|
| 532,132 | A | * | 1/1895 | Zaremba | 273/400 |
| 721,072 | A | * | 2/1903 | Nicholas | 273/317.1 |
| 1,371,263 | A | * | 3/1921 | Reed | 248/150 |
| 1,392,662 | A | * | 10/1921 | Seibold | 273/400 |
| 1,433,437 | A | * | 10/1922 | Wakeham | 273/400 |
| D110,225 | S | * | 6/1938 | Ponte | D21/702 |
| 2,301,265 | A | * | 11/1942 | Fandrey | 273/400 |
| 3,602,505 | A | * | 8/1971 | Friend | 473/470 |
| 3,685,826 | A | * | 8/1972 | Lehman | 273/343 |
| 4,482,157 | A | * | 11/1984 | McNeil | 473/470 |
| D277,884 | S | * | 3/1985 | Offutt | D21/702 |
| 4,611,812 | A | * | 9/1986 | Morrison | 473/485 |
| 4,826,177 | A | * | 5/1989 | Ponte | 273/400 |
| 5,549,293 | A | * | 8/1996 | Seifert | 273/317.3 |
| 5,807,195 | A | * | 9/1998 | Westbrook | 473/447 |
| 5,810,679 | A | * | 9/1998 | Yoakum | 473/472 |
| 6,692,385 | B2 | * | 2/2004 | Walker et al. | 473/447 |
| 6,808,176 | B2 | * | 10/2004 | Billig et al. | 273/400 |
| D554,193 | S | * | 10/2007 | Palmeri et al. | D21/305 |
| 7,401,785 | B1 | * | 7/2008 | Waite | 273/400 |
| 2004/0102260 | A1 | * | 5/2004 | Chia | 473/472 |
| 2007/0187897 | A1 | | 8/2007 | Dilling | |
| 2009/0151539 | A1 | * | 6/2009 | Baskerville | 84/421 |

FOREIGN PATENT DOCUMENTS

| | | |
|---|---|---|
| GB | 220970 | 9/1924 |
| GB | 603516 | 6/1948 |

OTHER PUBLICATIONS

Search Report from Corresponding GB Application No. 0724899.0, dated Mar. 25, 2008.

* cited by examiner

*Primary Examiner* — Mark S Graham
(74) *Attorney, Agent, or Firm* — Lerner, David, Littenberg, Krumholz & Mentlik, LLP

(57) ABSTRACT

A collapsible ball game basket comprising an entrance hoop and three or more legs, a device for holding the legs together at a predetermined position on each leg, a device for detachably connecting the upper end of each leg to said hoop and a device for locating the lower end of each leg on a ground sheet.

20 Claims, 3 Drawing Sheets

COLLAPSIBLE BALL GAME BASKET AND APPARATUS FOR PLAYING A BALL GAME

CROSS-REFERENCE TO RELATED APPLICATIONS

The present application claims priority from Great Britain Patent Application No. GB0724899.0, filed in the Great Britain Patent Office on Dec. 20, 2007, the entire content of which is incorporated herein by reference.

BACKGROUND OF THE INVENTION

This invention relates to a collapsible ball game basket which can form part of apparatus for playing a ball game.

The basket is intended to provide a target into which players can throw a ball. The game can be played on any relatively flat surface by four or more players and the collapsible ball game basket, according to the invention, can be readily assembled for use.

BRIEF SUMMARY OF THE INVENTION

According to the present invention, a collapsible ball game basket comprises an entrance hoop and three or more legs, means for holding the legs together at a predetermined position on each leg, means for detachably connecting the upper end of each leg to said hoop and means for locating the lower end of each leg on a ground sheet.

Thus, the basket can be dismantled into relatively small parts and stowed, for example, in a bag.

Means can be provided for adjusting the height of the entrance hoop from a supporting surface and in a preferred construction the ground sheet has a number of alternative positions to allow for different distances between the lower ends of the legs to provide alternative heights for the entrance hoop.

Any number of legs can be used but in a convenient arrangement three legs are provided and the alternative positions on the ground sheet are provided as triangles with alternative side lengths.

With this arrangement one position provides an apex for the triangle and the other two corners are provided by the alternative positions.

The locating positions can be provided by openings in the ground sheet which can be engaged by the lower ends of the legs and, thus, each leg can be provided with a lower peg portion which engages in the opening in the ground sheet.

The means for holding the legs together is preferably in the form of a resilient ring so that when the basket is collapsed the ring can stay in place and hold the legs together but can accommodate the relative movement between the legs when they are attached to the entrance hoop.

The upper ends of the legs can be connected to the entrance hoop by sliding rings so that they can take up a natural position on the hoop when the basket is assembled.

Preferably the entrance hoop comprises two or more detachable curved sections so that it can be taken apart to allow the rings to be removed.

Each of the legs can be formed in two detachable parts, each upper part being of curved configuration and with this arrangement the curved configuration of each of the upper parts of each leg is preferably the same as the curved configuration of the curved sections of the entrance hoop which thus enables them to be stacked together for storage.

The various parts can be made from metal, wood, synthetic plastics material or any other suitable material.

A net can be included which is adapted to hang downwardly from the circumference of the entrance hoop.

The invention also includes a collapsible ball game basket as set forth above in combination with a ball and means for marking out two or more concentric circles on a substantially flat surface to provide a defined area for playing a game.

BRIEF DESCRIPTION OF THE DRAWINGS

The invention can be performed in numerous ways but one embodiment will now be described by way of example and with reference to the accompanying drawings in which.

DETAILED DESCRIPTION

Figure 1:
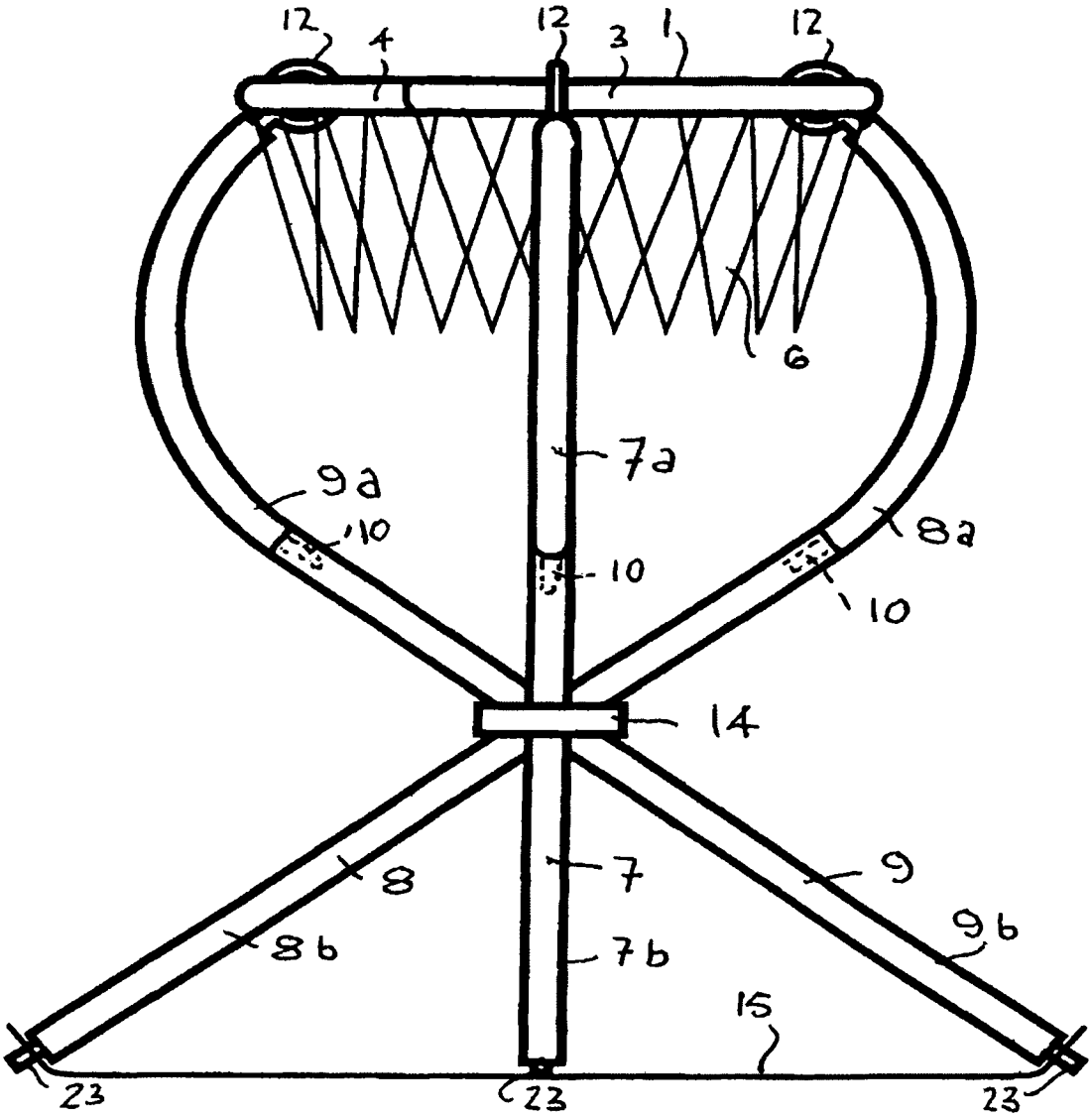
FIG. 1 is a diagrammatic side elevation of a collapsible ball game basket according to the present invention.

As shown in the drawings, the collapsible ball game basket according to the invention comprises an entrance hoop 1 which, in the example being described, is made up of three detachable curved sections 2, 3 and 4 which are made from curved tubular plastics material, one end of each of the curved sections being provided with a plug, indicated by reference numerals 2*a*, 3*a* and 4*a*, respectively, which can be pushed, as a close fit, into the adjacent end of the next curved section to form the hoop 1 and which can be released to collapse the hoop by pulling the ends apart.

Suspended from the entrance hoop 1 is a net 6 which can be attached to the hoop in any convenient way, for example, by providing a tube of netting (not shown) at the upper end through which the curved sections 2, 3 and 4 can be threaded or by merely threading the sections through the gaps in the netting itself.

The entrance hoop 1 is supported by three tubular legs 7, 8 and 9, respectively. Each leg is formed in two detachable parts each upper part being indicated by reference numerals 7*a*, 8*a* and 9*a* and each lower part by reference numerals 7*b*, 8*b* and 9*b*. The straight lower parts 7*b*, 8*b* and 9*b* are connected to the curved upper portions 7*a*, 8*a* and 9*a*, respectively, by plugs 10 which are carried on the upper leg parts 7*a*, 8*a* and 9*a*. The plugs push into the bores of the lower leg portions 7*b*, 8*b* and 9*b* which are made from a synthetic plastics material. The plugs 10 are detachable in a similar manner to the plugs in the entrance hoop 1.

The curved configuration of the upper parts of the legs is the same as the curved configuration of the curved sections 2, 3 and 4 of the entrance hoop so that when the entrance hoop and the legs are dismantled they can be easily stacked together.

The upper ends of each of the curved sections 7*a*, 8*a* and 9*a* carry a ring 12 which is a loose sliding fit on the entrance hoop 1 so that the legs can be easily threaded onto the hoop when the basket is assembled.

Means are provided for holding the legs 7, 8 and 9 together at a predetermined position on each leg by a resilient ring 14. The ring acts to clamp the legs together at a central position in relation to the height of the entrance hoop 1.

Figure 3:
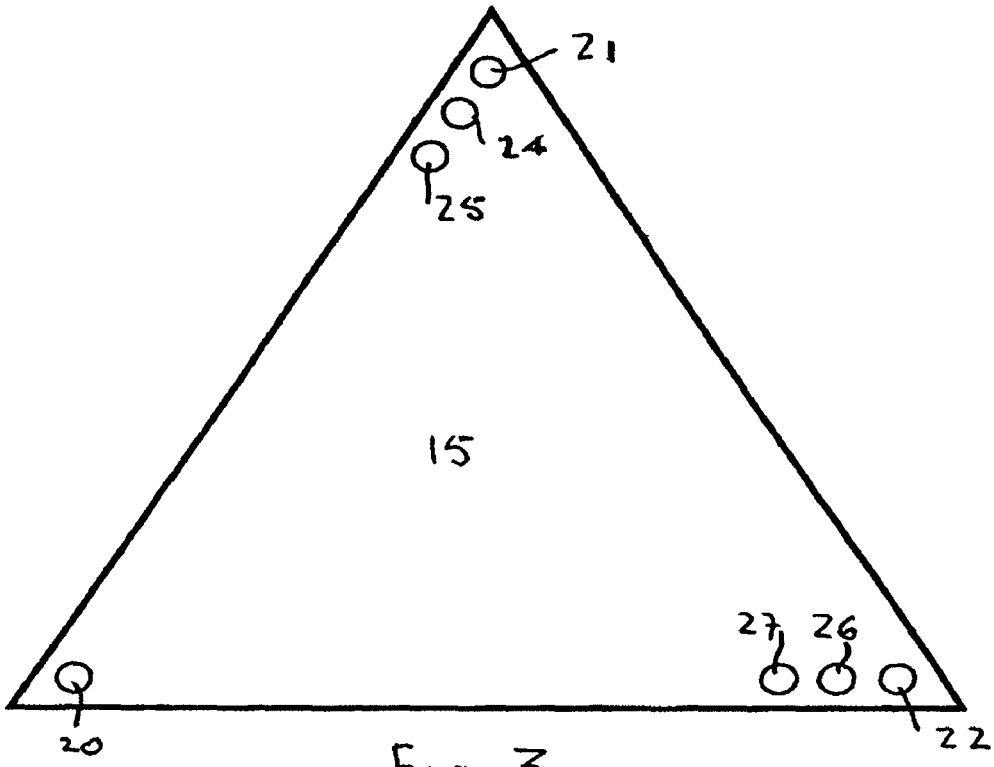
FIG. 3 is a plan view from above of the ground sheet used in the construction shown in FIGS. 1 and 2.
Figure 4:
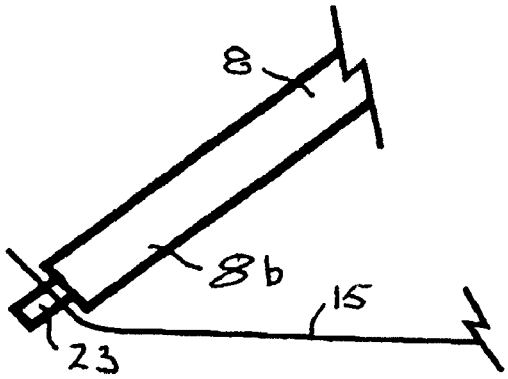
FIG. 4 is a part view of the lower part of one of the legs showing how it is located on the ground sheet; and, FIG. 5 is a diagrammatic plan view showing the layout of a court for playing a game in which the collapsible ball game basket, according to the invention, can be used.

Means are provided for locating the lower end 7*b*, 8*b* and 9*b* of the legs on a ground sheet 15 in the embodiment being described which can be of any suitable shape. As is most clearly shown in FIG. 3 the ground sheet 15 is of generally triangular shape and is provided with a number of alternative positions for locating the lower end of the legs. In the arrangement shown engagement holes 20, 21 and 22 are provided to accommodate the lower ends of the legs. Each of the lower ends of the legs is provided with a peg 23 which can be pushed through one of the appropriate openings 20, 21 and 22, as shown in FIG. 4. With this arrangement the legs are held in position and the height of the entrance hoop 1 will be at its lowest because the distance between the openings 20, 21 and 22 are at a maximum thus allowing the greatest distance between each of the legs. In order to be able to adjust the height of the entrance hoop from the level surface on which the basket is standing two further sets of openings are provided but only at the side spaced apart from the opening 20 which can be regarded as being at the apex of the triangle.

These further sets of openings are indicated by reference numerals 24, 25 and 26, 27. With one of the lower leg portions in position in the opening 20 the height of the entrance hoop can be raised by placing the lower portions of the other two legs in the openings 24 and 26 respectively and if the hoop is required to be higher again by alternatively placing these legs in the openings 25 and 27.

Thus, the different distances between the lower ends of the legs provide alternative heights for the entrance hoop and the alternative positions on the ground sheet 15 are provided as triangles with alternative side lengths.

Figure 2:
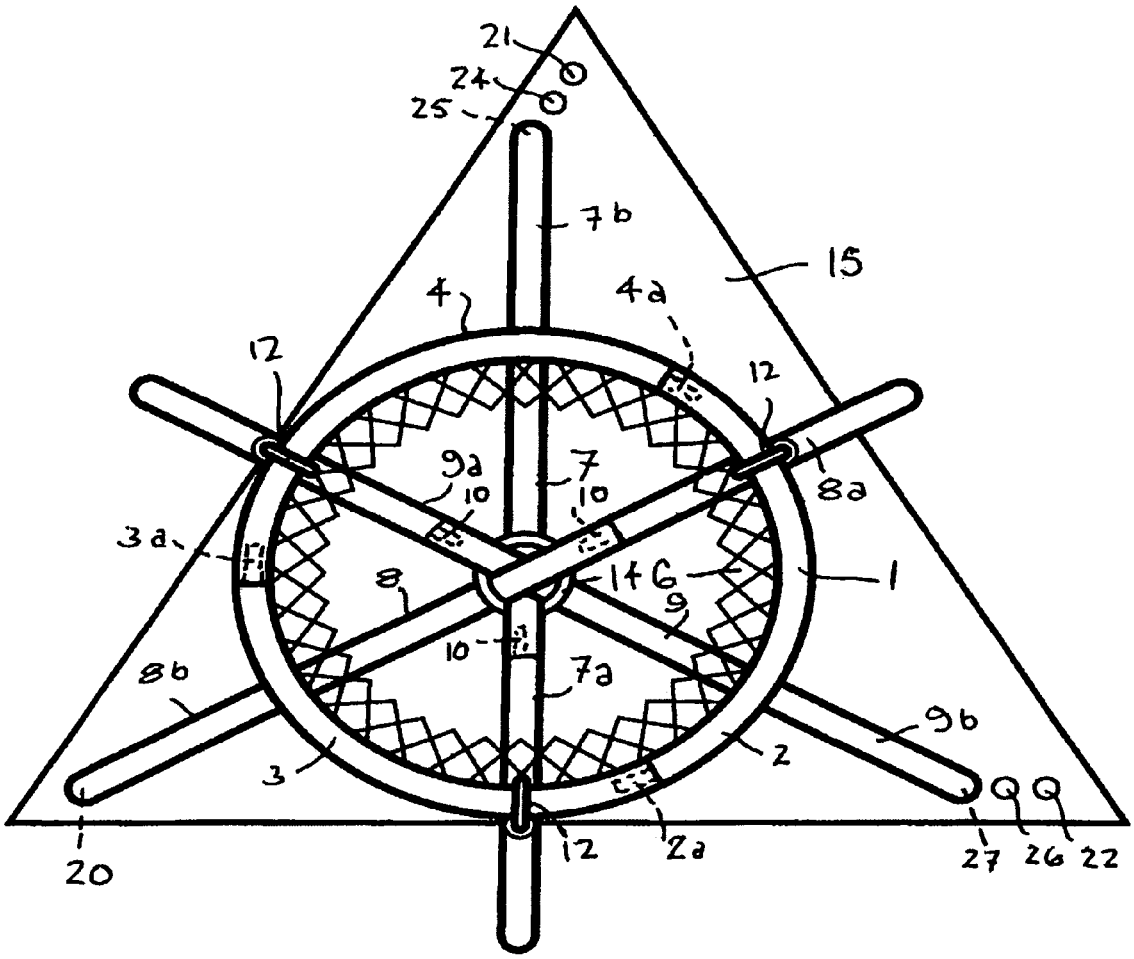
FIG. 2 is a diagrammatic plan view from above of the basket shown in FIG. 1.

In FIG. 2 the entrance hoop is shown at its greatest height from the level supporting surface because two of the legs are in the openings 25 and 27.

The use of the resilient ring 14 enables the legs to be adjusted, as required, and the sliding rings 12 take up their natural positions on the entrance hoop.

In the construction described above, three legs are used to support the entrance hoop but, in alternative constructions, any suitable number of legs, for example four or five, can be used but this will require an alternative arrangement of openings in the ground sheet.

The game basket according to the invention is easy to dismantle and can be stored in a small space which can be, for example, a bag so that it is easily transported.

The diameter of the entrance hoop can be between 60 cm and 1 m and the tubular sections which provide the legs and the hoop can be 4 cm in diameter.

The lengths of the legs and the distance between them can provide an overall height at the tallest position of 160 cm, an overall height in the middle position of 140 cm and an overall height at the lowest position of 120 cm and the overall dimensions of the triangular ground sheet 15 can be approximately 130 cm along each side.

The ground sheet 15 can be made of any suitable material, for example, a synthetic plastics material.

The intention of the different heights of the entrance hoop is to allow the game to be played by individuals of different ages, for example, the hoop could be at its lowest position for children and at its highest for active adults.

Figure 5:
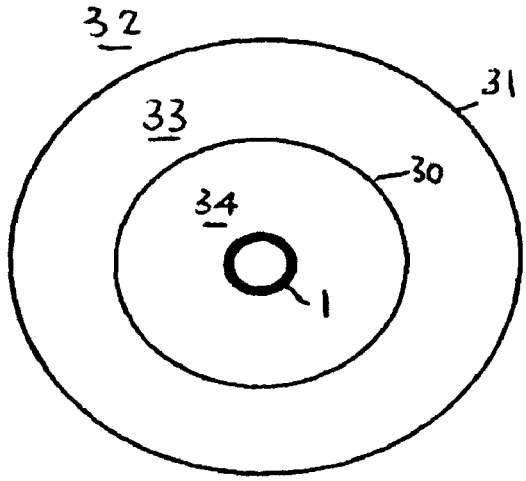

The game basket described above is intended for use with a ball and means for marking out two or more concentric circles on a substantially flat surface to provide a defined area for playing a game and FIG. 5 shows how a court can be made out. The position of the collapsible ball game basket is indicated by reference numeral 1.

The concentric circles which mark out the defined area can either be painted or otherwise marked permanently or semi-permanently on a suitable playing surface. Alternatively, means for marking out the two or more concentric circles can be provided by, for example, thin ropes or elongate shaped inflatable tubes.

In the arrangement shown in FIG. 5, the smaller circle 30 is approximately 3 m in diameter and the larger circle 31 is approximately 6 m in diameter when used, for example, for children but for adults the corresponding diameters can be 4 m and 8 m diameter. Any other form of portable markers could be employed. If, for example, a thin rope or line is used then its length could be made suitable for the adult game and it would only be necessary to reduce the length for the children's game by either overlapping the ends of the line or fastening them appropriately.

The playing areas defined by the circles are an outer area 32 outside the circle 31. A mid court area 33 between the circles 30 and 31 and an inner area 34 within the circle 30.

A round ball (not shown in the drawings) is also provided which is made from a medium/heavy sponge and of approximately 7 cm in diameter. Its outer surface can be made of material which is suitable to provide the soft side of a hook and loop type connection.

If desired a glove could also be provided which is primarily intended for younger players. The glove is a larger size than a typical baseball glove to accommodate the larger ball and has a surface on the palm which has a hook type surface to co-operate with the loop type surface if provided on the ball. The use of this type of connecting surface on the palm of the glove makes it easier for, for example a child, to catch the ball. The glove can be made interchangeable for use by left or right handed players.

The equipment described above is intended to provide a game which can be played by people of many ages on different surfaces and is primarily for use on a beach or in a park. It is not dependent on wind conditions, it is portable and can be played by multiple players from 4 or above. The players can have low skills and there can be advanced players. The game will accommodate different strategies and styles of play. The game can be played with 6 players and it is possible to play with 8 or more players and have two balls in play at any one time.

The objective of the game and, for example, one point would be scored when a ball is thrown into the basket. The rules could be such that when the first team or player scores up to eleven points he, she or the team wins.

The use of the ground sheet not only adds strength to the overall construction of the basket but can also be used to further strengthen the foundation providing the ability to add weights, for example sand if playing on a beach, or rucksacks, or other articles. This helps to keep the tripod upright If the ball hits the hoop at speed.

The game may be played in various ways but a set of Rules is now set out below by way of example:

Rules 1.1 One team starts with the ball, starting as the attacking team, the other as the defending team.

1.2 Players may not enter the Inner Area unless picking up the ball from the ground, (e.g. after a basket has been scored or after a missed or blocked shot), otherwise players can move freely in all other areas.

1.3 Players can only score from the Outer Area.

1.4 Players can only defend from the Mid Court.

1.5 There is no limit to the number of times players can pass the ball to fellow team members. (This is to enable them to get the defending players out of position.)

1.6 After shooting and scoring, the opposing team take possession of that ball.

1.7 If the ball falls to the ground possession goes to the team who did not touch the ball last.

Defending 2.1 To 'block' means that any part of the body can be used to stop the ball going either into the basket or to another player.

2.2 Defending players cannot force the ball away from the attacking player—the ball may only be blocked once the ball has been thrown.

2.3 The defending players can only block a shot when they are inside the Mid Court.

Attacking

For the following Rules, the descriptions—'Team 1' and 'Team 2'—are to help describe specific Rules.

3.1 When Team 1 shoots but misses the basket, and:

a) the ball falls to the ground without making contact with other players, possession goes to Team 2.

b) the ball is caught by a member of Team 1 before the ball hits the ground, possession goes to Team 1.

c) the ball is caught by a member of Team 2 before the ball hits the ground, possession goes to Team 2.

3.2 When Team 1 shoots or passes the ball and a defending player from Team 2 blocks the shot (or makes any contact with the ball) and;

a) the ball falls to the ground, possession goes back to Team 1.

b) the ball is caught by a member of Team 1, Team 1 takes possession.

c) the ball is caught by a member of Team 2, Team 2 takes possession.

d) the ball goes into the basket, Team 1 scores the point.

This is a non contact sport. This means there are some specific Rules regarding the movement of players in attacking and defending moves 4.1 When a player has the ball, the defending player must not impede his movement if it is sideways or reversing away from the centre.

4.2 Attacking players may not stand in the mid circle between a fellow team member who is shooting and a defending player.

Alternative Rules for 8 or more players 5.1 As the team size increases the number of balls that can be played at any one time also increases*, i.e. with 4 or 6 players the game is played with one ball, with 8 or more players 2 balls can be used.

5.2 If two balls are used and each team is in possession of a ball both teams may be attacking and defending at the same time!

5.3 A player can defend in the Mid Circle even if he is carrying a ball.

5.4 One player can hold both balls.

5.5 When one team scores and 1 ball is still in play, the games does not stop. The team who takes possession of the scoring ball makes the decision when to retrieve the ball from the ground.

Further Alternative Rules

*Players may only catch the ball with one hand and throw with the other. (For children, the velcro glove is used for catching. If this is not used, two hands may be used to catch the ball.)

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A collapsible ball game basket comprising an entrance hoop supported by and three or more legs, each of said legs having an upper end and a lower end, the upper end of each leg being detachably attached to said entrance hoop and the lower end of each leg being shaped to rest on a supporting surface, each leg extending diametrically across and beneath said entrance hoop and crossing the other legs at a predetermined position between its upper and lower end beneath said entrance hoop, and means for holding each leg to the other legs at said predetermined position wherein the means for holding the legs together at the predetermined position is a resilient ring.

2. The collapsible ball game basket as claimed in claim 1 in which the supporting surface includes a ground sheet, which extends between each of said legs and which has spaced apart location means to receive and locate the lower end of each of said legs.

3. The collapsible ball game basket as claimed in claim 2 in which said ground sheet has a number of alternative positions to allow for different distances between the lower end of the legs to provide alternative heights for the entrance hoop.

4. The collapsible ball game basket as claimed in claim 3 in which three legs are provided and the alternative positions on the ground sheet are provided as triangles with alternative side lengths.

5. The collapsible ball game basket as claimed in claim 4 in which one position provides an apex and other two corners of the triangles being provided by the alternative positions.

6. The collapsible ball game basket as claimed in claim 2 in which the locating positions are provided by openings in the ground sheet which can be engaged by the lower ends of the legs.

7. The collapsible ball game basket as claimed in claim 6 in which the lower ends of the legs are provided with peg portions which engage in the openings in the ground sheet.

8. The collapsible ball game basked as claimed in claim 1 in which the upper ends of the legs are connected to the entrance hoop by sliding rings.

9. The collapsible ball game basket as claimed in claim 1 in which the entrance hoop comprises two or more detachable curved sections.

10. The collapsible ball game basket as claimed in claim 1 in which each of said legs is formed in two detachable parts, each upper part being of curved configuration.

11. A collapsible ball game basket as claimed in claim 10 in which the curved diameter of each of the upper parts of each leg is the same as the curved diameter of the curved sections of the entrance hoop which comprises two or more detachable curved sections.

12. The collapsible ball game basket as claimed in claim 1 which includes a net adapted to hang downwardly from the circumference of the entrance hoop.

13. The collapsible ball game basket as claimed in claim 1 in combination with a ball and means for marking out two or more concentric circles on a substantially flat surface to provide a defined area for playing a game.

14. The collapsible ball game basket as claimed in claim 1 wherein the supporting surface has a number of alternative positions to allow for different distances between the lower end of the legs to provide alternate heights for the entrance hoop.

15. The collapsible ball game basket as claimed in claim 14 wherein three legs are provided and the alternative position on the supporting surface are provided as triangles with alternative side lengths.

16. The collapsible ball game basket as claimed in claim 15 in which one position provides an apex and other two corners of the triangles being provided by the alternative positions.

17. The collapsible ball game basket as claimed in claim 14 in which the locating positions are provided by openings in the supporting surface which can be engaged by the lower end of the legs.

18. A collapsible ball game basket comprising an entrance hoop supported by and three or more legs, each of said legs having an upper end and a lower end, the upper end of each leg being detachably attached to said entrance hoop and the lower end of each leg being shaped to rest on a supporting surface, each leg extending diametrically across and beneath said entrance hoop and crossing the other legs at a predetermined position between its upper and lower end beneath said entrance hoop, and means for holding each leg to the other legs at said predetermined position, wherein the supporting surface includes a ground sheet, which extends between each of said legs and which has spaced apart location means to receive and locate the lower end of each of said legs wherein said ground sheet has a number of alternative positions to allow for different distances between the lower end of the legs to provide alternative heights for the entrance hoop and wherein three legs are provided and the alternative positions on the ground sheet are provided as triangles with alternative side lengths.

19. A collapsible ball game basket comprising an entrance hoop supported by and three or more legs, each of said legs having an upper end and a lower end, the upper end of each leg being detachably attached to said entrance hoop and the lower end of each leg being shaped to rest on a supporting surface, each leg extending diametrically across and beneath said entrance hoop and crossing the other legs at a predetermined position between its upper and lower end beneath said entrance hoop, and means for holding each leg to the other legs at said predetermined position wherein the upper ends of the legs are connected to the entrance hoop by sliding rings.

20. The collapsible ball game basked as claimed in claim 19 in which the entrance hoop comprises two or more detachable curved sections.

* * * * *

UNITED STATES PATENT AND TRADEMARK OFFICE

CERTIFICATE OF CORRECTION

PATENT NO. : 7,896,350 B2
APPLICATION NO. : 12/317252
DATED : March 1, 2011
INVENTOR(S) : Jonathan Harries It is certified that error appears in the above-identified patent and that said Letters Patent is hereby corrected as shown below:

Column 1, line 15, “part of apparatus” should read --part of the apparatus--.
Column 2, line 45, “detachable parts” should read --detachable parts,--.
Column 4, line 3, “elongate shaped” should read --elongate-shaped--.
Column 4, line 16, “31. A mid court” should read --31 and a mid court--.
Column 4, line 19, “sponge and of” should read --sponge of--.
Column 4, line 22, “loop type” should read --loop-type--.
Column 4, line 26, “hook type” should read --hook-type--.
Column 4, line 27, “loop type” should read --loop-type--.
Column 4, line 29, “for, for example a child, to catch” should read --for, for example, a child to catch--.
Column 4, line 30-31, “right handed” should read --right-handed--.
Column 4, line 66, “take” should read --takes--.
Column 5, line 33, “non contact” should read --non-contact--.
Column 5, line 35, “defending moves” should read --defending moves.--.
Column 6, line 6, “by and three or more” should read --by three or more--.
Column 6, line 13, “end” should read --ends--.
Column 6, line 42, “basked” should read --basket--.
Column 7, line 2, “position” should read --positions--.
Column 7, line 6, “and other two” should read --and the other two--.
Column 7, line 12, “basket comprising” should read --basket and supporting surface comprising--.
Column 7, line 13, “supported by and three” should read --supported by three--.
Column 7, line 19, “lower end” should read --lower ends--.
Column 8, line 9, “supported by and three” should read --supported by three--.
Column 8, line 15, “end” should read --ends--.
Column 8, line 19, “basked” should read --basket--.

Signed and Sealed this
Twentieth Day of March, 2012

David J. Kappos

David J. Kappos
*Director of the United States Patent and Trademark Office*